US006109176A

United States Patent [19]

Fujio et al.

[11] Patent Number: 6,109,176

[45] Date of Patent: Aug. 29, 2000

[54] PRINTING UNIT DRIVE APPARATUS FOR A ROTARY PRESS

[75] Inventors: Noboru Fujio, Hamura; Yoshinori Uera, Kawasaki; Daisuke Nakamura, Yokohama; Kazuyuki Motojima, Kawasaki, all of Japan

[73] Assignee: Tokyo Kikai Seisakusho, Ltd., Tokyo, Japan

[21] Appl. No.: 09/158,135

[22] Filed: Sep. 22, 1998

[30] Foreign Application Priority Data

Oct. 29, 1997 [JP] Japan ..... 9-311566

[51] Int. Cl.[7] ..... B41F 5/00

[52] U.S. Cl. ..... 101/216; 101/DIG. 41

[58] Field of Search ..... 101/181, 183, 101/136, 141, 152, 153, 173, 174, 180, 212, 216, 248, 484, DIG. 41

[56] References Cited

U.S. PATENT DOCUMENTS

| | | | |
|---|---|---|---|
| 3,808,895 | 5/1974 | Fitzwater | 74/2 |
| 4,350,091 | 9/1982 | Myles | 100/271 |
| 4,643,091 | 2/1987 | Fairey | 101/233 |
| 4,951,567 | 8/1990 | Rodi et al. | 101/216 |
| 5,676,055 | 10/1997 | Schwinn et al. | 101/216 |
| 5,720,222 | 2/1998 | Reichardt et al. | 101/216 |

FOREIGN PATENT DOCUMENTS

| | | |
|---|---|---|
| 63-115749 | 5/1988 | Japan . |
| 2-23091 | 6/1990 | Japan . |
| 7-504625 | 5/1995 | Japan . |
| 8-13543 | 2/1996 | Japan . |
| 8-34108 | 2/1996 | Japan . |
| 8-103996 | 4/1996 | Japan . |
| 8-85196 | 4/1996 | Japan . |

*Primary Examiner*—Ren Yan

*Attorney, Agent, or Firm*—Armstrong, Westerman, Hattori, McLeland & Naughton

[57] ABSTRACT

A printing unit drive apparatus for a rotary press which includes a single or plural printing units and a single or plural folding units. The drive apparatus includes a motor capable of driving a driven portion of each unit, a connection mechanism for drivingly connecting the motor with the driven portion, and a brake mechanism and a reduction gear mechanism disposed in the connection mechanism. All or some of the motors are selectively combined and operated in a synchronized manner. When supply of electricity to the motors is stopped, the motors stop simultaneously without continuing their independent inertial rotation.

6 Claims, 4 Drawing Sheets

PRINTING UNIT DRIVE APPARATUS FOR A ROTARY PRESS

BACKGROUND OF THE INVENTION

1. Field of the Invention

The present invention relates to a printing unit drive apparatus for a rotary press, and more particularly to a printing unit drive apparatus for a so-called shaft-less rotary press which includes at least one printing unit, folding units in a number not greater than the number of the printing units, and electric drive means provided for each of the printing and folding units, and in which the respective electric drive means are electrically connected to and controlled by a controller such that the respective electric drive means independently drive the respective printing and folding units in a synchronized manner.

2. Description of the Related Art

A rotary press which includes at least one printing unit and folding units in a number not greater than the number of the printing units is well known and is used, for example, as a rotary press for printing newspapers.

In such a rotary press, rotary portions of respective units must be rotated together in a state such that the rotational phase and the velocity of each rotary portion match those of other rotary portions.

For such a synchronized drive, in conventional techniques, a single main drive shaft is provided and is connected to a single or a plurality of electric drive means to be driven thereby; and rotation of the main drive shaft is transmitted to drive shafts provided for respective units via a gear train or the like. That is, by means of mechanical linkage among the respective units, the respective units are operated all together in a state such that the rotational phase and the velocity of each rotary portion match those of other rotary portions.

However, since such a mechanical linkage mechanism requires a large number of parts and is complicated and large, manufacturing costs increases, and its operation, maintenance, and management are troublesome. In order to overcome the above-described drawbacks, there has been proposed a so-called shaft-less rotary press. In the shaft-less rotary press, at lease one electric drive means is provided for each of printing and folding units; the respective electric drive means of the units are rotated together while being electrically synchronized; and the rotational phase and speed of each rotary portion are controlled electrically. Thus, the respective units are operated in a mutually matching manner. Such a shaft-less rotary press is disclosed in, for example, Japanese Patent Application Laid-Open Nos. 8-34108, 8-85196, and 8-103996.

Japanese Patent Application Laid-Open No. 8-34108 discloses a printing unit drive apparatus in which the shaft of one plate cylinder and the shaft of one blanket cylinder are connected via gears for interlocked operation, and these cylinders serving as a driven portion are driven by a single electric drive means. Further, as a preferred embodiment, there is described in detail a drive apparatus in which the rotor shaft of the electric drive means and the journal of one of the cylinders serving as a driven portion are disposed such that their axes become parallel to each other and perpendicular to the frame of the printing unit, and the rotor shaft of the electric drive means and the journal of one of the cylinders are connected via a transmission mechanism including a timing belt and timing belt pulleys.

Japanese Patent Application Laid-Open No. 8-85196 discloses a printing unit drive apparatus for a printing unit which includes a combination of a plate cylinder and a blanket cylinder, or a combination of a plate cylinder, a blanket cylinder, and an impression cylinder. In the drive apparatus, one to all of the cylinders of the printing unit serve as a driven portion, and an appropriate cylinder of the driven portion is connected directly to electric drive means to be driven thereby, and the cylinder and the remaining cylinders are connected via gears for interlocked operation.

Further, as a preferred embodiment, there is described in detail a mechanism for fixing the rotor shaft of the electric drive means to the journal of the cylinder, as well as a drive mechanism for fixing the tip end of the rotor shaft of the electric drive means to the side end portion of the cylinder in order to use the rotor shaft of the electric drive means as the journal of the cylinder.

Japanese Patent Application Laid-Open No. 8-103996 discloses a printing unit drive apparatus in which a single or a plurality of rotatable functional components (e.g., a driven component such as a blanket cylinder) is/are connected directly and securely to electric drive means. Further, as a preferred embodiment, there is described in detail a drive apparatus in which, in order to establish direct and secure connection between the electric drive means and an appropriate cylinder serving as a driven portion, there is employed a connection mechanism such that the end shaft of the cylinder is extended into the electric drive means and a rotor is attached thereto, whereby the end shaft of the cylinder is used as the rotor shaft of the electric drive means.

The above-described conventional drive apparatuses have the following drawbacks.

First, all of the drive apparatuses disclosed in the three publications lack braking means, because they are designed based on the consideration that during operation printing units can be braked through electrical control of the electric drive means. However, in such a braking scheme, there is not taken into account stoppage of the printing units that occurs when supply of electricity to the electric drive means is shut off, for example, at the time of power failure.

That is, in the conventional drive apparatuses, when supply of electricity to the electric drive means is shut off, control of the electric drive means becomes impossible, and driven portions of the respective printing units continue their rotation, due to inertial force, in an uncontrolled state. Therefore, each driven portion starts to rotate independently of other driven portions, and there arise accidents such that the tension acting on paper web—which is caused to travel by means of rotation of the driven portions—changes at longitudinal positions, resulting in rupture of the paper web and such that ruptured paper web winds around a rotating driven portion (e.g., blanket cylinder).

Further, in the drive apparatus disclosed in Japanese Patent Application Laid-Open No. 8-34108 and having a transmission mechanism composed of a timing belt and timing belt pulleys, in order to transmit a desired drive force, there must be taken either or both of the following measures: (1) increasing the distance between the timing belt pulleys in order to increase the contact angle between the timing belt and the timing belt pulleys; and (2) increasing the face width of the timing belt pulleys and the timing belt. Therefore, a large space is required for installation of the drive apparatus.

In addition, in the drive apparatus disclosed in Japanese Patent Application Laid-Open No. 8-34108, since the timing belt is caused to travel at high speed, the timing belt disturbs the surrounding air to sometimes generate high-pitched noise, thereby deteriorating the working environment.

Moreover, in the drive apparatus, since the rotor shaft of the electric drive means and the end shaft of the driven portion are disposed such that their axes become parallel to each other and perpendicular to the frame of the printing unit, the amount of projection of the printing unit in the direction perpendicular to the frame surface increases, so that the printing unit occupies a relatively large space in the direction perpendicular to the frame.

Meanwhile, in the drive apparatuses disclosed in Japanese Patent Application Laid-Open Nos. 8-85196 and 8-103996, the rotor shaft of the electric drive means and the end shaft of the driven portion are directly connected with each other, and thus there is overcome the drawback of the above-described drive apparatus equipped with a timing-belt type transmission mechanism. However, since no reduction mechanism is disposed between the rotor shaft of the electric drive means and the end shaft of the driven portion, it becomes necessary to use electric drive means that can output a large torque, resulting in an increase in size of the electric drive means. In order to cope with this new problem of an increase in the size of the electric drive means to thereby reduce the size of the electric drive means, there is employed a structure in which only one cylinder among a plate cylinder, a blanket cylinder, and an impression cylinder is selected as a driven portion that is driven by a single electric drive means, or there is employed a special electric drive means in which a common shaft is used as the end shaft of the driven portion and the rotor shaft of the electric drive means.

However, in the case where only one cylinder is driven by a single electric drive means, each printing unit requires a plurality of electric drive means whose number is not less than the number of the cylinders; i.e., three to nine electric drive means. In addition, more complicated control means is required in order to rotate all the respective cylinders together at the same speed while matching their rotational phase to each other. Further, failures and malfunctions occur more frequently, and maintenance and inspection become troublesome. Moreover, in a so-called divided plate cylinder which has a width corresponding to four pages of newsprint and whose circumferential surface is axially divided into two surfaces, which are to be driven separately, two electric drive means are required for one plate cylinder. Therefore, the above-described drawbacks become more remarkable.

Further, since the electric drive means is directly connected to the driven portion, the electric drive means must be operated in a relatively low efficient state in order to rotate the driven portion at a desired speed (e.g., 625 rpm) for steady printing operation. In addition, when the above-described special electric drive means is used, costs increase, and in view of failure and repair, special parts must be stocked. Moreover, work for repair and part replacement requires accuracy, which in turn requires experience.

Moreover, in the drive apparatuses disclosed in Japanese Patent Application Laid-Open Nos. 8-85196 and 8-103996, since the rotor shaft of the electric drive means and the end shaft of the driven portion are disposed such that their axes become coaxial with each other and perpendicular to the frame of the printing unit, the amount of projection of the printing unit in the direction perpendicular to the frame surface increases, so that the printing unit occupies a relatively large space in the direction perpendicular to the frame.

SUMMARY OF THE INVENTION

An object of the present invention is to provide a printing unit drive apparatus that solves the above-mentioned problems in the conventional techniques.

According to the present invention, there is provided a printing unit drive apparatus for a rotary press which includes at least one printing unit and folding units in a number not greater than the number of the printing units, the drive apparatus comprising electric drive means capable of driving a driven portion of each unit; a connection mechanism for drivingly connecting the electric drive means with the driven portion; and a brake mechanism disposed in the connection mechanism or the electric drive means and adapted to provide braking operation when supply of electricity to the electric drive means is stopped. All or some of the electric drive means of the printing and folding units are selectively combined and operated in a synchronized manner in order to operate all or some of the printing and folding units together.

Preferably, in addition to the brake mechanism, a reduction gear mechanism is provided in the connection mechanism or the electric drive means.

The electric drive means is preferably accommodated inside the edge of a frame such that the center axis of a rotor shaft becomes horizontal and parallel to the frame surface of the printing unit. Also, the brake mechanism is preferably disposed between the rotor shaft of the electric drive means and the end shaft of the driven portion. The brake mechanism may be disposed within the electric drive means.

Preferably, the brake mechanism is a fluid-pressure-operated brake mechanism connected to a fluid pressure source via an electromagnet valve that is switched to supply pressurized fluid to the fluid-pressure-operated brake mechanism when electricity is not supplied to the electromagnet valve.

In the printing unit drive apparatus for a rotary press according to the present invention, when supply of electricity to the electric drive means is stopped due to a power failure, misoperation, or the like, while the printing unit is operating, the brake means operates immediately, so that in each unit the electric drive means and the driven portion driven thereby—i.e., the electric drive means and a group of rotary operation members drivingly connected to the electric drive means—are all stopped together.

Accordingly, it becomes possible to prevent independent rotations of the respective units which would otherwise occur due to inertial force until the units stop completely, thereby preventing rupture of paper web and winding of rupture paper web around a rotating portion. As a result, there can be prevented a decrease in operation rate of the printing unit and wasteful use of paper web due to paper rupture. In addition, there can be prevented damage of a rotating portion or the like of the printing unit which would otherwise occur due to winding of rupture paper web around the rotating portion.

In the case where a reduction mechanism is provided, the torque that the electric drive means must generate can be decreased, so that the size of the electric drive means can be reduced.

In addition, since the reduction mechanism is provided, during design the rotational speed of the electric drive means can be freely set so as to rotate the driven portion at a desired speed (e.g., 625 rpm) for steady printing operation. Therefore, the electric drive means can be operated in a relatively high efficiency state, contributing to energy conservation.

Moreover, since the reduction mechanism is a reduction gear mechanism, there does not arise a problem of noise generation which occurs in the conventional timing belt type reduction mechanism. Further, installation space can be decreased compared to the case of the conventional timing belt type reduction mechanism, which requires a large installation space due to a large contact angle between the timing belt and the timing-belt pulleys.

That is, in the case where the reduction mechanism is provided, in addition to the basic effects such as prevention of decrease in the operation rate, prevention of waste of paper web, and prevention of breakage of the printing unit, there can be obtained an effect of decreasing noise, size, space, and energy consumption of the drive unit.

Moreover, since a single electric drive means is provided for each printing unit, the drive control of the printing unit can be simplified, and frequency of failure or malfunction in relation to the drive control can be decreased.

In addition, since the rotor shaft of the electric drive means is disposed horizontally, the rotor shaft can be supported substantially equally at its two ends, so that uneven application of load onto the bearings can be prevented. Accordingly, the electric drive means can be operated stably for a long period of time.

Since the electric drive means is disposed parallel to the frame of the printing unit, the amount of projection of the printing unit in the direction perpendicular to the surface can be minimized in order to prevent the electric drive means from projecting beyond the frame edge. Accordingly, the installation area of the printing unit can be decreased, and a worker does not hit his/her body on a projection or trip over the projection.

Moreover, a general purpose motor can be used as the electric drive means, and spare parts and replacement parts can be easily obtained. Further, even inexperienced workers can perform maintenance and repair with relative ease. Accordingly, when a failure or malfunction occurs, recovery work can be performed quickly, and a reduction in the operation rate of the printing unit can be minimized.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE PREFERRED EMBODIMENT

A printing unit drive apparatus for a rotary press according to an embodiment of the present invention will now be described with reference to the drawings.

Figure 4:
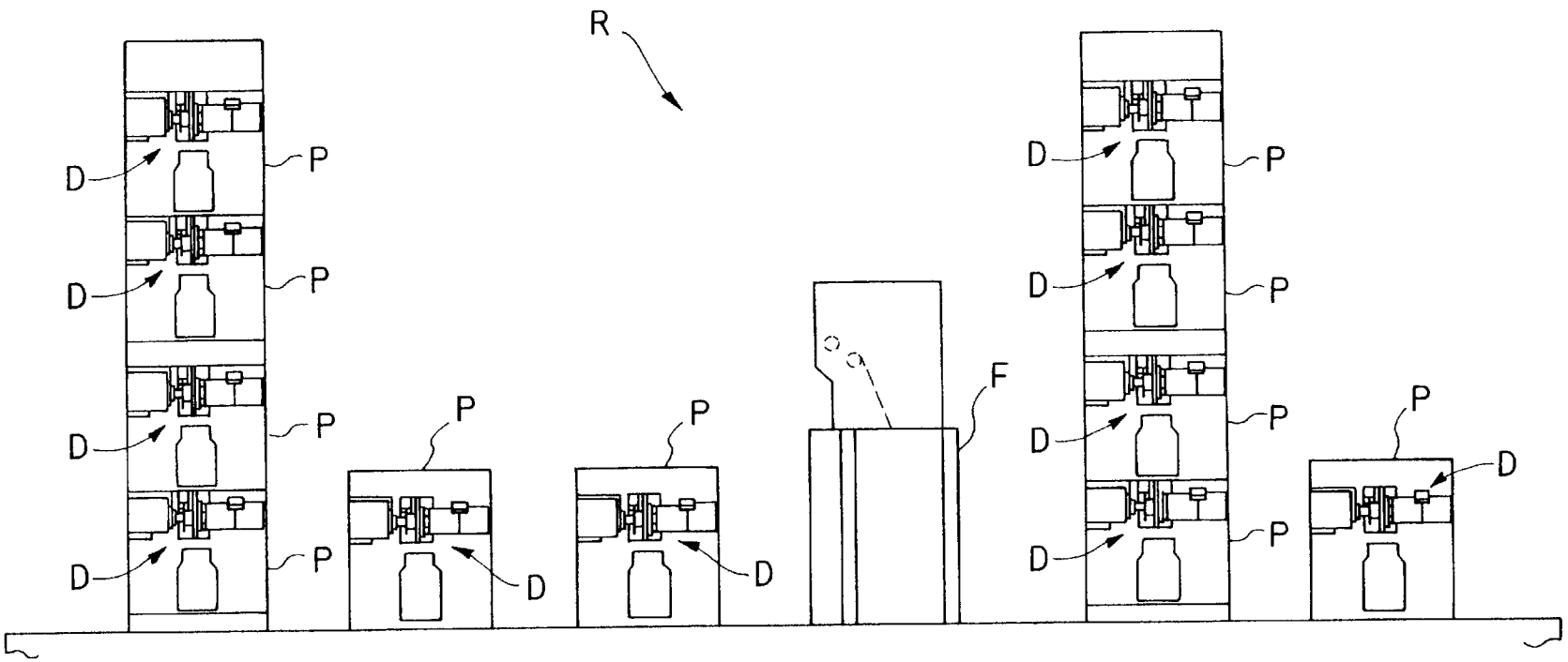
FIG. 4 is a front view of a rotary press equipped with the printing unit drive apparatus according to the embodiment of the present invention.

The printing unit drive apparatus for a rotary press according to the embodiment of the present invention is applied to each of a plurality of printing units P of a rotary press, as shown in FIG. 4, that is equipped with the printing units P together with a folding unit F. In FIG. 4, drive apparatuses D of the printing units P are shown in an exposed state.

Figure 1:
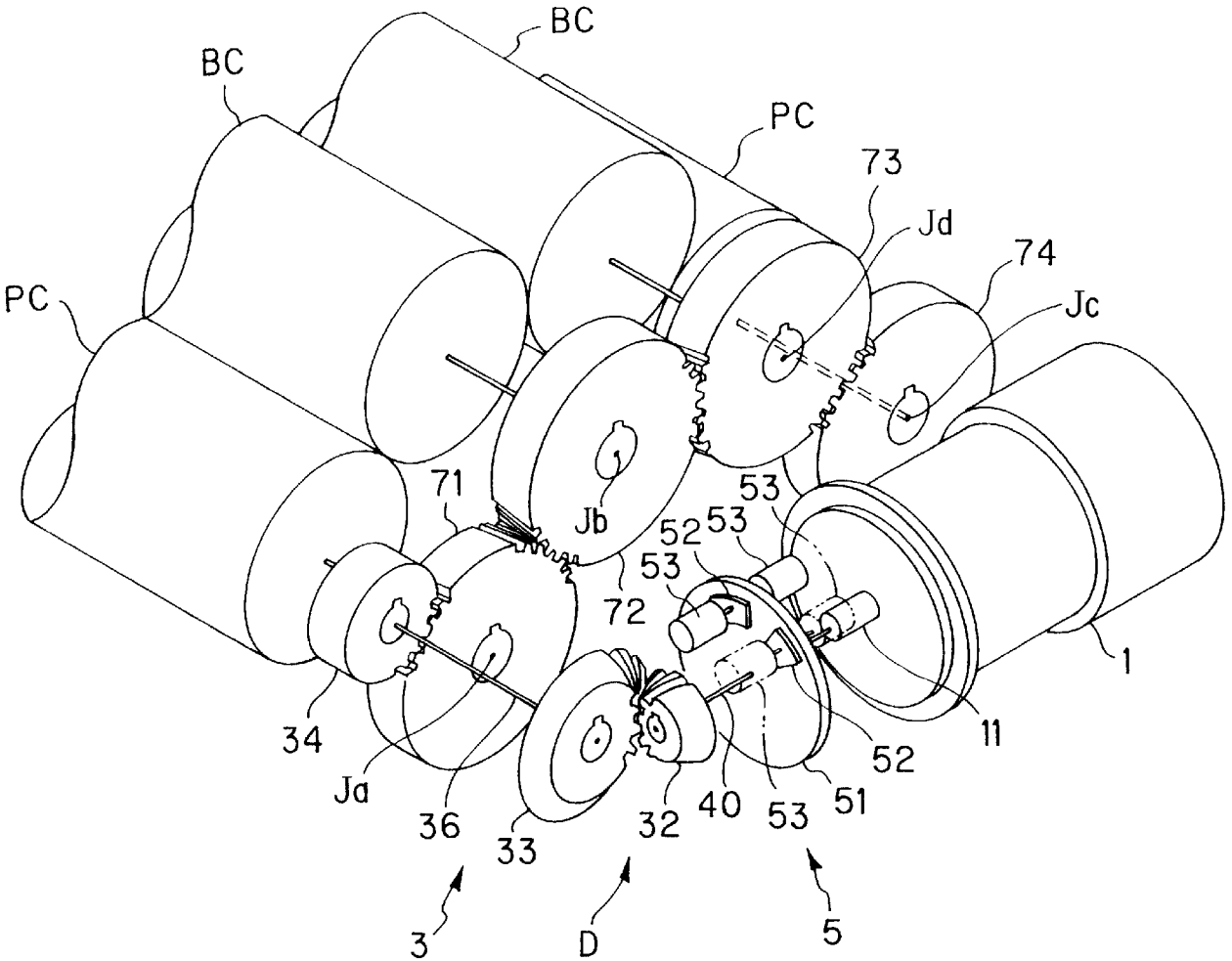
FIG. 1 is a perspective view of a main portion of a printing unit drive apparatus for a rotary press according to an embodiment of the present invention.

As shown in FIG. 1, the drive apparatus D of the printing unit P is applied to a so-called BB-type offset printing press which has two printing couples each composed of a plate cylinder PC and a blanket cylinder BC disposed in contact with each other, and an unillustrated paper web is passed between the cylinders so that printing is performed on both faces of the paper web.

As shown in FIG. 1, the drive apparatus D for the printing unit P includes electric drive means 1, a reduction gear mechanism 3, and a brake mechanism 5. The reduction gear mechanism 3 is interposed between the electric drive means 1 and the journal Ja of a plate cylinder PC located at the upstream end of the driven portion and constitutes a part of a connection mechanism for drivingly connecting the electric drive means 1 and the journal Ja. The brake mechanism 5 is interposed between the electric drive means 1 and the reduction gear mechanism 3.

The electric drive means 1 is an inverter induction motor whose speed can be changed continuously through electrical control. The rotor shaft 11 of the electric drive means 1 is disposed horizontal and perpendicular to the rotational axes of the cylinders of the printing couple. A first shaft 40 serving as an output shaft of the brake mechanism 5 is connected to the rotor shaft 11 in an aligned manner, and a spiral bevel gear 32 attached to the tip end of the first shaft 40 is in meshing engagement with a spiral bevel gear 33 attached to one end of an intermediate shaft 36, which is disposed parallel to the rotational axes of the cylinders of the printing couple. The gear ratio between the spiral bevel gears 32 and 33 is set to, for example, 1:2 in order to obtain a ½ speed reduction.

Meanwhile, bevel gears 71 and 72 are attached to the journals Ja and Jb of the plate cylinder PC and the blanket cylinder BC of one pair, while bevel gears 73 and 74 are attached to the journals Jc and Jd of the plate cylinder PC and the blanket cylinder BC of the other pair. The bevel gears 71, 72, 73, and 74 constitute a meshed gear train.

The bevel gear 71 at the upstream end is in meshing engagement with a bevel gear 34 attached to the other end of the intermediate shaft 36. The gear ratio between the bevel gears 34 and 71 is set to, for example, 1:2 in order to obtain a ½ speed reduction.

In some cases, the power transmission path formed by the gear train composed of the bevel gears 71, 72, 73, and 74 may be made more complicated in order to avoid a problem caused by backlash of the gears. However, this does not relate directly to the present invention, and its description will be omitted.

Further, in the printing unit used in a rotary press as shown in FIG. 4, in which a plurality of printing units P are stacked in the vertical direction, and by which multi-color printing is performed on paper web that passes through these printing units P successively, a correction mechanism may be provided in order to correct differences in positions of printed images. This also does not relate directly to the present invention, and its description will be omitted.

Figure 2:
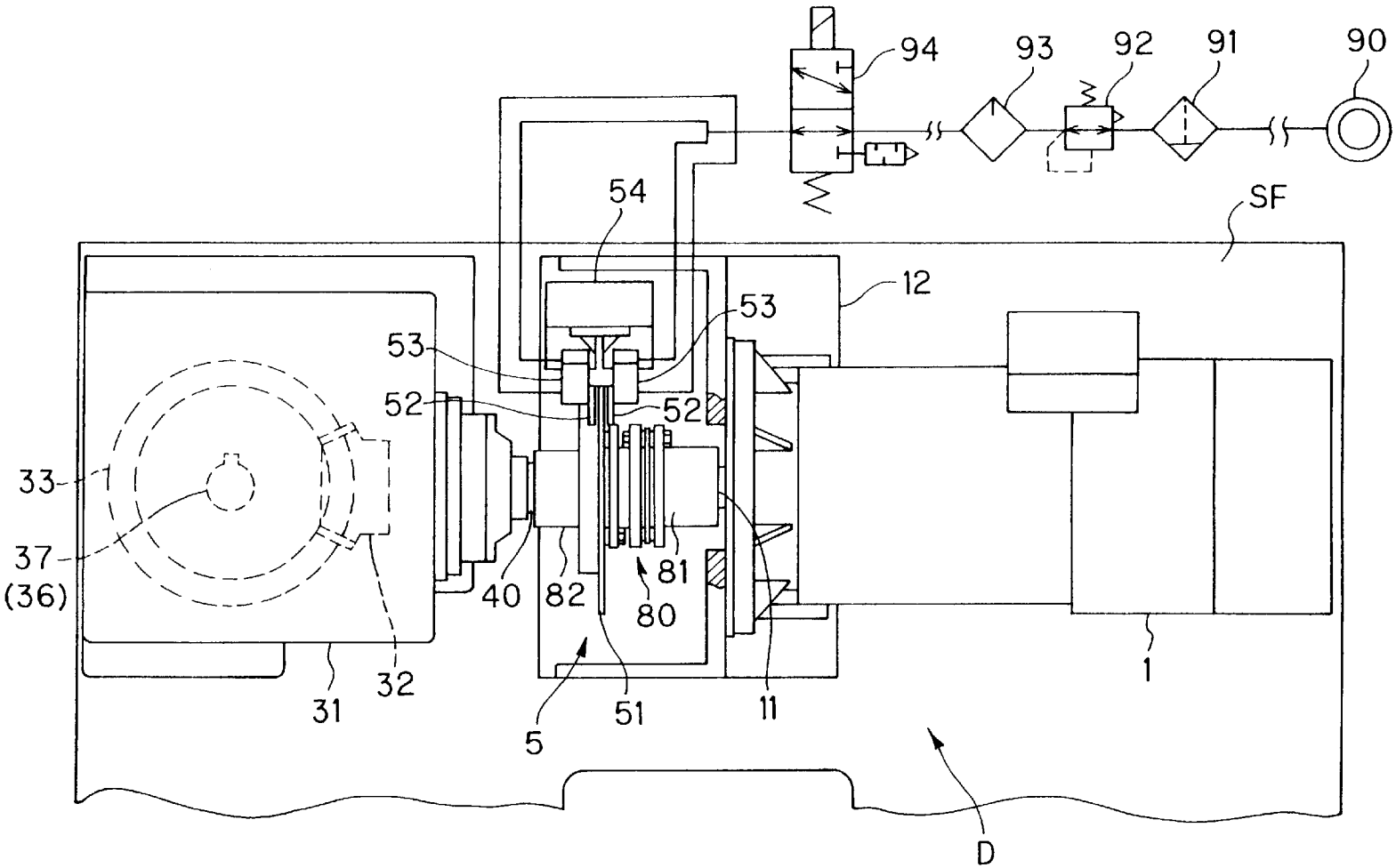
FIG. 2 a font view of the printing unit drive apparatus according to the embodiment of the present invention.
Figure 3:
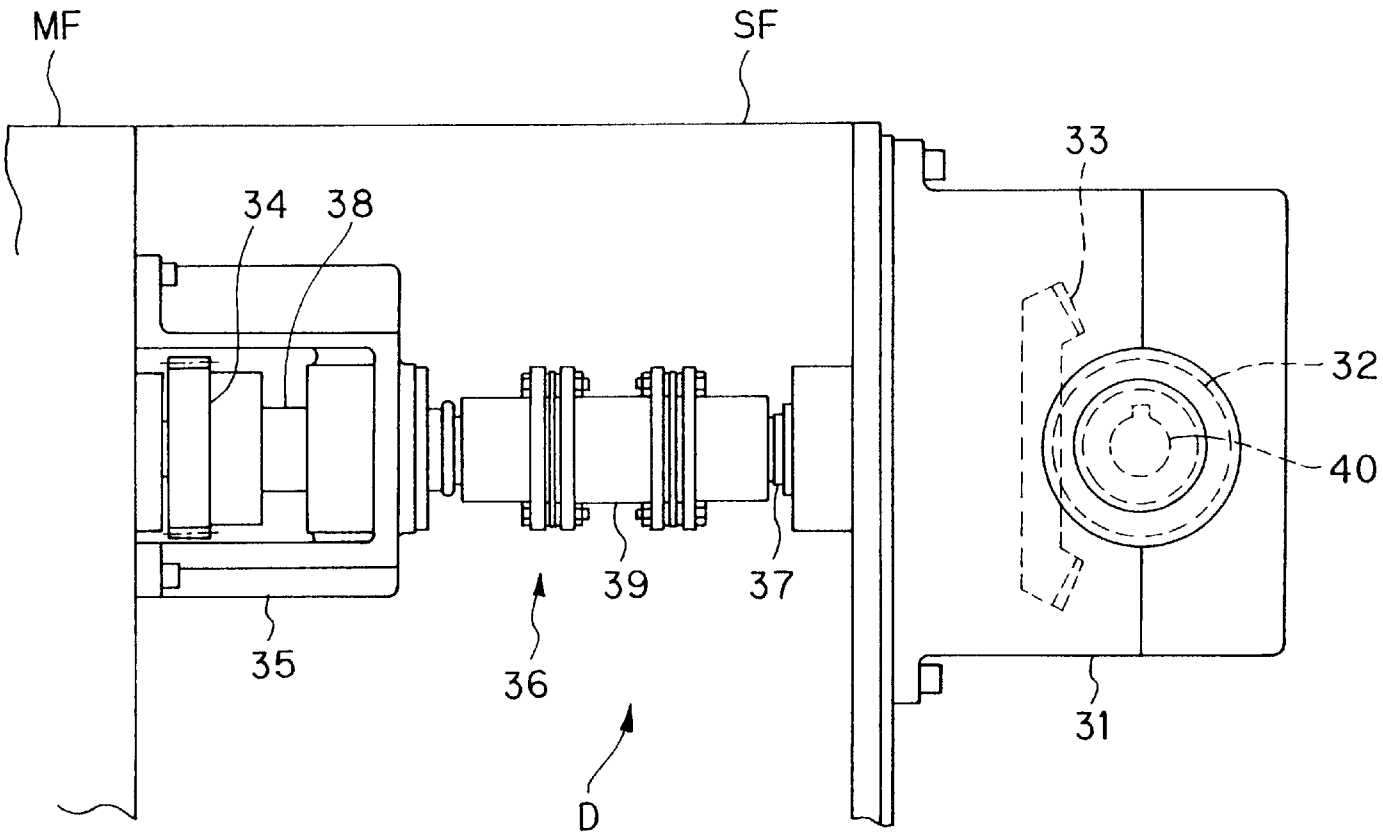
FIG. 3 a side view of the printing unit drive apparatus according to the embodiment of the present invention.

FIGS. 2 and 3 show specific structures of the electric drive means 1 and the brake mechanism 5 of the drive unit D of the printing unit P, and the specific structure of the gear train composed of the spiral bevel gear 32 attached to the first shaft 40, the intermediate shaft 36, the spiral bevel gear 33 and the bevel gear 34 attached to the intermediate shaft 36, and the bevel gears 71, 72, 73, and 74.

On the outside surface (front surface in FIG. 2) of a frame MF of the printing unit P is provided a subframe SF having an outside surface whose shape is substantially the same as that of the frame MF. A bracket 12 and a gear box 31 are attached to the subframe SF such that they are separated in the front/back direction (left/right direction in FIG. 2).

The electric drive means 1 is attached to the bracket 12 such that it becomes parallel to the side surface of the frame MF of the printing unit P; i.e., such that the rotor shaft 11 becomes perpendicular to the rotational axes of the cylinders of the printing couple.

A first end of the first shaft 40—which is on the same axis as that of the rotor shaft 11 of the electric drive means 1 and is rotatably supported by means of the gear box 31—is located in the gear box 31, and the spiral bevel gear 32 is attached to the first end. A second end of the first shaft 40 faces the tip end of the rotor shaft 11 and is connected to the rotor shaft 11 by means of a shaft coupling 80. Specifically, the shaft coupling 80 is composed of first and second coupling members 81 and 82 each having a sleeve portion and a flange portion. The rotor shaft 11 and the first shaft 40 are respectively inserted into the sleeves of the first and second coupling members 81 and 82 in a state in which free movement is restricted in at least the rotational direction. The two flange portions are coupled together by use of bolts. Thus, the rotor shaft 11 and the first shaft 40 are connected with each other.

The brake mechanism 5 for braking the first shaft 40 and the rotor shaft 1 includes a brake disk 51, two pairs of brake-pad drive means 53, and two pairs of brake pads 52 (see FIG. 1). The brake disk 51 is fixed to the sleeve portion of one coupling member of the shaft coupling 80 (the second coupling member 82 in the illustrated example). The brake-pad drive means 53 are attached to the bracket 12 via a bracket 54 such that each pair of the brake-pad drive means 53 are located at a proper position on the subframe SF and face each other with the brake disk 51 being interposed therebetween. The brake-pad drive means 53 releasably press the brake pads 52 against the brake disk 51.

The brake-pad drive means 53 includes an air cylinder mechanism containing a compression spring therein. The air cylinder mechanism is connected to an air supply/drain circuit, in which a pressurized air source 90, a filter 91, a pressure governor 92, a lubricator 93, and a two-position, three-port electromagnet valve 94 are connected successively by air passages.

In the illustrated example, as described above, the brake mechanism 5 is disposed in the middle of the connection portion extending from the rotor shaft 11 of the electric drive means 1 to the journal Ja of the plate cylinder PC located at the upstream end in the driven portion. However, the brake mechanism 5 may alternatively be disposed within the electric drive means 1.

The intermediate shaft 36 is composed of a second shaft 37 and a third shaft 38. The second shaft 37 is rotatably supported by means of the gear box 31 to be horizontal and perpendicular to the first shaft 40 and the rotor shaft 11. The third shaft 38 is rotatably supported by means of the box-shaped bracket 35 attached to the side surface of the frame MF of the printing unit P. The second and third shafts 37 and 38 are coupled coaxially via a shaft coupling 39. To one end of the second shaft 37 located in the gear box 31 is attached the spiral bevel gear 33 in meshing engagement with the spiral bevel gear 32. To one end of the third shaft 38 located in the bracket 35 is attached the bevel gear 34 in meshing engagement with the bevel gear 71 located at the upstream end of the two printing couples.

Next will be given a description of operation of the above-described printing unit drive apparatus for a rotary press.

When a desired printing operation is to be performed, some of the printing units P of the rotary press shown in FIG. 4 are selected and electrically combined by use of an unillustrated operation control apparatus. The operation control apparatus then rotates the electric drive means 1 of the respective printing units P in a synchronized manner.

Before electricity is supplied from a drive power source to the electric drive means 1, in response to, for example, a start of the operation control apparatus, the operation control apparatus drives a solenoid of the two-position, three-port electromagnet valve 94 of the air circuit for operating the brake mechanism 5. As a result, the air passage communicating with the pressurized air source 90 is shut off, while the air passage communicating with the brake-pad drive means 53 is connected to an exhaust port. Consequently, the brake pads 52 are separated from the brake disk 51 by means of spring force. Accordingly, the brake mechanism 5 is not operating while the printing unit P is being operated.

When the electric drive means 1 of each printing unit P starts its rotation, rotation of the electric drive means 1 is transmitted to the bevel gear 71 via the rotor shaft 11, the shaft coupling 80, the first shaft 40, the spiral bevel gear 32, the spiral bevel gear 33, the intermediate shaft 36, and the bevel gear 34. As a result, the bevel gear 71 rotates at a speed that is reduced to ¼ by means of the reduction gear mechanism 3. The rotation of the bevel gear 71 is then successively transmitted to the bevel gears 72, 73, and 74. Thus, the two printing couples; i.e., the two plate cylinders PC and the two blanket cylinders BC, are all rotated together.

By means of the simultaneous rotation, printing is effected on the paper web passing between the adjacent plate cylinders PC in each printing unit P.

When supply of electricity to the electric drive means 1 is stopped, for example, due to a power failure, misoperation, or the like, while the printing unit P is operating (i.e., the electric drive means 1 is rotating), supply of electricity to the solenoid of the two-position, three-port electromagnet valve 94 of the air circuit 2 for operating the brake mechanism 5 is stopped simultaneously to demagnetize the solenoid. As a result, the air passage communicating with the pressurized air source 90 is connected to the air passage communicating with the brake-pad drive means 53. Consequently, pressurized air is supplied to the air cylinder mechanisms of the brake-pad drive means 53, so that the brake-pad drive means 53 press the brake pads 52 against the brake disk 51 counter to the spring force of the compression springs contained therein. Thus, a brake force is applied to the brake disk 51 to stop its rotation.

When supply of electricity to the electric drive means 1 is stopped, all the rotating members on the printing couple side and the electric drive means 1 side (i.e., all the plate cylinders PC and the blanket cylinder BC mechanically linked with each other via the gear trains (bevel gears 71–74) and the rotor of the electric drive means 1) tend to continue their rotation, due to inertial force, in an uncontrolled state. However, since the plate cylinders PC and the blanket cylinder BC and the rotor of the electric drive means 1 are all connected to the brake disk 51, these members stop simultaneously.

Accordingly, the plurality of units P selectively operated in the rotary press stop simultaneously without continuing their independent and uncontrolled rotation.

Obviously, numerous modifications and variations of the present invention are possible in light of the above teachings. It is therefore to be understood that within the scope of the appended claims, the present invention may be practiced otherwise than as specifically described herein.

What is claimed is:

1. A printing unit drive apparatus for a rotary press which includes at least one printing unit and folding units in a number not greater than the number of the printing units, said drive apparatus comprising:

electric drive means capable of driving a driven portion of each unit;

a connection mechanism for drivingly connecting said electric drive means with said driven portion;

a brake mechanism disposed in said connection mechanism or said electric drive means and adapted to provide braking operation when supply of electricity to said electric drive means is stopped; and a fluid pressure source to supply pressurized fluid to said brake mechanism via an electromagnet valve that is switched to supply pressurized fluid to said brake mechanism when electricity is not supplied to said electromagnet valve, wherein all or some of said electric drive means of said printing and folding units are selectively combined and operated in a synchronized manner in order to operate all or some of said printing and folding units together.

2. A printing unit drive apparatus according to claim 1, further comprising a frame wherein said electric drive means is accommodated inside the edge of the frame such that a center axis of a rotor shaft becomes horizontal and parallel to a frame surface of said printing unit.

3. A printing unit drive apparatus according to claim 1, wherein said driven portion includes an end shaft and said brake mechanism is disposed between a rotor shaft of said electric drive means and the end shaft of said driven portion.

4. A printing unit drive apparatus for a rotary press which includes at least one printing unit and folding units in a number not greater than the number of the printing units, said drive apparatus comprising:

electric drive means capable of driving a driven portion of each unit;

a connection mechanism for drivingly connecting said electric drive means with said driven portion;

a brake mechanism and a reduction gear mechanism disposed in said connection mechanism or said electric drive means and adapted to provide braking operation when supply of electricity to said electric drive means is stopped; and a fluid pressure source to supply pressurized fluid to said brake mechanism via an electromagnet valve that is switched to supply pressurized fluid to said brake mechanism when electricity is not supplied to said electromagnet valve, wherein all or some of said electric drive means of said printing and folding units are selectively combined and operated in a synchronized manner in order to operate all or some of said printing and folding units together.

5. A printing unit drive apparatus according to claim 4, further comprising a frame wherein said electric drive means is accommodated inside the edge of the frame such that a center axis of a rotor shaft becomes horizontal and parallel to a frame surface of said printing unit.

6. A printing unit drive apparatus according to claim 4, wherein said driven portion includes an end shaft and said brake mechanism is disposed between a rotor shaft of said electric drive means and the end shaft of said driven portion.

* * * * *